US008800993B2

(12) United States Patent
Blaha et al.

(10) Patent No.: US 8,800,993 B2
(45) Date of Patent: Aug. 12, 2014

(54) CARD HANDLING SYSTEMS, DEVICES FOR USE IN CARD HANDLING SYSTEMS AND RELATED METHODS

(75) Inventors: Ernst Blaha, Tullnerbach (AT); Peter Krenn, Neufeld (AT); Attila Grauzer, Las Vegas, NV (US); Todd M. Haushalter, Las Vegas, NV (US)

(73) Assignee: Shuffle Master GmbH & Co KG, Vienna (AT)

( * ) Notice: Subject to any disclaimer, the term of this patent is extended or adjusted under 35 U.S.C. 154(b) by 0 days.

(21) Appl. No.: 13/270,109

(22) Filed: Oct. 10, 2011

(65) Prior Publication Data

US 2012/0091656 A1 Apr. 19, 2012

Related U.S. Application Data

(60) Provisional application No. 61/393,299, filed on Oct. 14, 2010.

(51) Int. Cl.
*A63F 1/12* (2006.01)

(52) U.S. Cl.
USPC ..... 273/149 R

(58) Field of Classification Search
CPC ..... A63F 13/12; A63F 1/12
USPC ..... 273/149 R
See application file for complete search history.

(56) References Cited

U.S. PATENT DOCUMENTS 3,897,954 A * 8/1975 Erickson et al. ..... 273/149 R
4,586,712 A 5/1986 Lorber et al.
4,770,421 A * 9/1988 Hoffman ..... 273/149 R
5,275,411 A 1/1994 Breeding
5,356,145 A 10/1994 Verschoor
5,374,061 A 12/1994 Albrecht et al.
5,382,024 A 1/1995 Blaha
5,584,483 A 12/1996 Sines et al.
5,605,334 A * 2/1997 McCrea, Jr. ..... 273/309
5,676,372 A * 10/1997 Sines et al. ..... 273/149 R
5,683,085 A * 11/1997 Johnson et al. ..... 273/149 R
5,695,189 A 12/1997 Breeding et al.
5,707,287 A 1/1998 McCrea et al.
5,735,525 A 4/1998 McCrea et al.

(Continued)

FOREIGN PATENT DOCUMENTS

CN 201139926 10/2008

OTHER PUBLICATIONS

PCT International Search Report and Written Opinion of the International Searching Authority for PCT/GB2011/051978, dated Jan. 17, 2012, 11 pages.

*Primary Examiner* — Kurt Fernstrom
*Assistant Examiner* — Dolores Collins
(74) *Attorney, Agent, or Firm* — TraskBritt

(57) ABSTRACT

Card handling systems include shuffling devices, shoe devices, and a card transfer system for automatically transferring cards from the shuffling device into the shoe device. Shuffling devices may include a divider configured to contact at least one card positioned within a compartment of the shuffling device. Shoe devices may include a card loading system for loading cards into a card storage area through an opening in a base of the shoe device. Methods of providing cards during a casino table game play include identifying card information including a rank and a suit of each card in a shuffling device and a shoe device and transporting cards from the shuffling device to the shoe device.

25 Claims, 5 Drawing Sheets

(56) References Cited

U.S. PATENT DOCUMENTS

| | | | | |
|---|---|---|---|---|
| 5,911,626 | A | 6/1999 | McCrea et al. | |
| 5,944,310 | A * | 8/1999 | Johnson et al. | 273/149 R |
| 6,019,368 | A * | 2/2000 | Sines et al. | 273/149 R |
| 6,093,103 | A | 7/2000 | McCrea et al. | |
| 6,117,012 | A | 9/2000 | McCrea et al. | |
| 6,149,154 | A * | 11/2000 | Grauzer et al. | 273/149 R |
| 6,254,096 | B1 * | 7/2001 | Grauzer et al. | 273/149 R |
| 6,254,484 | B1 | 7/2001 | McCrea, Jr. | |
| 6,267,248 | B1 * | 7/2001 | Johnson et al. | 209/547 |
| 6,299,167 | B1 | 10/2001 | Sines et al. | |
| 6,346,044 | B1 | 2/2002 | McCrea, Jr. | |
| 6,582,301 | B2 | 6/2003 | Hill | |
| 6,588,750 | B1 | 7/2003 | Grauzer et al. | |
| 6,651,981 | B2 * | 11/2003 | Grauzer et al. | 273/149 R |
| 6,651,982 | B2 * | 11/2003 | Grauzer et al. | 273/149 R |
| 6,655,684 | B2 | 12/2003 | Grauzer et al. | |
| 6,659,460 | B2 | 12/2003 | Blaha et al. | |
| 6,676,127 | B2 | 1/2004 | Johnson et al. | |
| 6,698,756 | B1 | 3/2004 | Baker et al. | |
| 6,889,979 | B2 | 5/2005 | Blaha | |
| 6,959,925 | B1 | 11/2005 | Baker et al. | |
| 7,036,818 | B2 * | 5/2006 | Grauzer et al. | 273/149 R |
| 7,059,602 | B2 | 6/2006 | Grauzer et al. | |
| 7,384,044 | B2 * | 6/2008 | Grauzer et al. | 273/149 R |
| 7,523,937 | B2 * | 4/2009 | Fleckenstein | 273/149 R |
| 7,556,266 | B2 * | 7/2009 | Blaha et al. | 273/149 R |
| 7,677,565 | B2 * | 3/2010 | Grauzer et al. | 273/149 R |
| 7,699,694 | B2 | 4/2010 | Hill | |
| 7,740,244 | B2 * | 6/2010 | Ho | 273/149 R |
| 7,753,373 | B2 * | 7/2010 | Grauzer et al. | 273/149 R |
| 7,764,836 | B2 * | 7/2010 | Downs et al. | 382/181 |
| 7,766,332 | B2 * | 8/2010 | Grauzer et al. | 273/149 R |
| 7,933,448 | B2 | 4/2011 | Downs, III | |
| 7,946,586 | B2 * | 5/2011 | Krenn et al. | 273/149 R |
| 7,967,294 | B2 * | 6/2011 | Blaha et al. | 273/149 R |
| 8,002,638 | B2 * | 8/2011 | Grauzer et al. | 463/47 |
| 8,011,661 | B2 * | 9/2011 | Stasson | 273/149 R |
| 8,025,294 | B2 * | 9/2011 | Grauzer et al. | 273/149 R |
| 8,141,875 | B2 * | 3/2012 | Grauzer et al. | 273/149 R |
| 8,210,536 | B2 * | 7/2012 | Blaha et al. | 273/149 R |
| 8,342,525 | B2 * | 1/2013 | Scheper et al. | 273/149 R |
| 8,419,521 | B2 * | 4/2013 | Grauzer et al. | 463/17 |
| 8,444,147 | B2 * | 5/2013 | Grauzer et al. | 273/149 R |
| 2002/0017481 | A1 | 2/2002 | Johnson et al. | |
| 2003/0075866 | A1 | 4/2003 | Blaha | |
| 2007/0018389 | A1 | 1/2007 | Downs | |
| 2013/0099448 | A1 * | 4/2013 | Scheper et al. | 273/309 |

* cited by examiner

CARD HANDLING SYSTEMS, DEVICES FOR USE IN CARD HANDLING SYSTEMS AND RELATED METHODS

CROSS-REFERENCE TO RELATED APPLICATION

This application claims the benefit of U.S. Provisional Patent Application Ser. No. 61/393,299, filed Oct. 14, 2010, the disclosure of which is hereby incorporated herein in its entirety by this reference.

TECHNICAL FIELD

Embodiments of the present disclosure relate generally to the field of gaming and the field of casino table card gaming. More particularly, embodiments of the disclosure relate to systems and devices for the handling of playing cards and related methods.

BACKGROUND

Wagering games based on the outcome of randomly generated arrangements of cards are well known. Such games are widely played in gaming establishments and, often, a single deck or multiple decks of fifty-two (52) playing cards may be used to play the game. Gaming using multiple decks of playing cards may include, for example, six or eight decks used in games such as blackjack and baccarat and two decks of playing cards used in games such as double deck blackjack. Many other specialty games may use single or multiple decks of cards, with or without jokers and with or without selected cards removed.

From the perspective of players, the time the dealer must spend in shuffling diminishes the excitement of the game. From the perspective of casinos, shuffling time reduces the number of hands played and specifically reduces the number of wagers placed and resolved in a given amount of time, consequently reducing casino revenue. Casinos would like to increase the amount of revenue generated by a game without changing the game or adding more tables. One approach is to simply speed up play. One option to increase the speed of play is to decrease the time the dealer spends shuffling.

The desire to decrease shuffling time has led to the development of mechanical and electromechanical card shuffling devices. Such devices increase the speed of shuffling and dealing, thereby increasing actual playing time. Such devices also add to the excitement of a game by reducing the amount of time the dealer or house has to spend in preparing to play the game.

Dealers appreciate using card shufflers that place minimum strain on the dealer's hands, back, and arms. Some existing shuffler designs put unnecessary strain on the muscles of the users. Dealers prefer shufflers that exhibit a low profile with respect to the surface of the gaming table, especially when the shuffler dispenses cards into a game rather than shufflers that shuffle batches of cards for shoe games.

Numerous approaches have been taken to the design of card shufflers. These approaches include random ejection designs (e.g., U.S. Pat. Nos. 6,959,925; 6,698,756; 6,299,167; 6,019,368; 5,676,372; and 5,584,483), stack separation and insertion (e.g., U.S. Pat. Nos. 5,683,085 and 5,944,310), interleaving designs (e.g., U.S. Pat. Nos. 5,275,411 and 5,695,189), for example, random insertion using a blade (U.S. Pat. No. 5,382,024), and designs that utilize multiple shuffling compartments.

One such example of a compartment shuffler is disclosed in U.S. Pat. No. 4,586,712 to Lorber et al. The automatic shuffling apparatus disclosed is designed to intermix multiple decks of cards under the programmed control of a computer. The apparatus is a carousel-type shuffler having a container, a storage device for storing shuffled playing cards, a removing device and an inserting device for intermixing the playing cards in the container, a dealing shoe, and supplying means for supplying the shuffled playing cards from the storage device to the dealing shoe. The container includes multiple card-receiving compartments, each one capable of receiving a single card.

Another shuffler having mixing compartments arranged in a carousel is disclosed in U.S. Pat. No. 6,267,248 to Johnson et al. Cards are loaded into an infeed tray, fed sequentially past a card reading sensor, and are inserted into compartments within a carousel to either randomize or sort cards into a preselected order. The carousel moves in two directions during shuffling. U.S. Pat. No. 6,676,127 to Johnson et al. describes another variation of the shuffler, in which cards are inserted into and removed from a same side of the carousel, with the card infeed tray being located above the discard tray (see FIG. 3).

U.S. Pat. No. 3,897,954 to Erickson et al. discloses a device for delivering cards, one at a time, into one of a number of vertically stacked card-shuffling compartments. A logic circuit is used to determine the sequence for determining the delivery location of a card. The card shuffler can be used to deal stacks of shuffled cards to a player.

U.S. Pat. No. 4,770,421 to Hoffman discloses a card-shuffling device including a card loading station with a conveyor belt. The belt moves the lowermost card in a stack onto a distribution elevator whereby a stack of cards is accumulated on the distribution elevator. Adjacent to the elevator is a vertical stack of mixing pockets. A microprocessor preprogrammed with a finite number of distribution schedules sends a sequence of signals to the elevator corresponding to heights called out in the schedule. Each distribution schedule comprises a preselected distribution sequence that is fixed, as opposed to random. Single cards are moved into the respective pocket at that height. The distribution schedule is either randomly selected or schedules are executed in sequence. When the microprocessor completes the execution of a single distribution cycle, the cards are removed a stack at a time and loaded into a second elevator. The second elevator delivers cards to an output reservoir.

U.S. Pat. No. 5,275,411 to Breeding discloses a machine for automatically shuffling and dealing hands of cards. Although this device does not shuffle cards by distributing cards to multiple compartments, the machine is believed to be the first of its kind to deliver randomly arranged hands of cards to a casino card game. A single deck of cards is shuffled and then cards are automatically dispensed into a hand-forming tray. The shuffler includes a deck-receiving zone, a carriage section for separating a deck into two deck portions, a sloped mechanism positioned between adjacent corners of the deck portions, and an apparatus for snapping the cards over the sloped mechanism to interleave the cards. The Breeding shuffler was originally designed to be used in connection with single deck poker style games such as LET IT RIDE® Stud Poker and a variant of Pai Gow Poker marketed as WHO'S FIRST™ Pai Gow Poker.

In an attempt to speed the rate of play of specialty table games equipped with a shuffler, the ACE® card shuffler, as disclosed in U.S. Pat. Nos. 6,149,154, 6,588,750, 6,655,684, and 7,059,602, was developed. This shuffler operates at faster speeds than previously known shuffler devices described above, has fewer moving parts, and requires much shorter setup time than the prior designs. The shuffler includes a card infeed tray, a vertical stack of shuffling compartments and a card output tray. A first card moving mechanism (card mover) advances cards individually from the infeed tray into a compartment. A processor randomly directs the placement of fed cards into the compartments, and an alignment of each compartment with the first card mover, forming random groups of cards within each compartment. Groups of cards are unloaded by a second card moving mechanism into the output tray.

Another compartment shuffler capable of delivering randomly arranged hands of cards for use in casino card games is the ONE2SIX® shuffler (developed by Shuffle Master GMBH & Co KG, formerly known as Casino Austria Research & Development (CARD)). This shuffler is disclosed in U.S. Pat. Nos. 6,659,460 and 6,889,979. This shuffler is capable of delivering randomly arranged hands of cards when a first removable delivery end is attached, and is capable of delivering a continuous supply of cards from a shoe-type structure when a second removable delivery end is attached. Cards are fed from a feeder individually into compartments within a carousel to accomplish random ordering of cards. Shuffling is also accomplished by random unloading of groups of cards.

Most of the known shuffler designs, in particular multi-deck shufflers, require some sort of interaction (e.g., by a dealer) in the shuffling process such as removing the shuffled playing cards from the shuffler and placing the cards in a shoe for use by a dealer. Such interaction and transfer of the cards to a different device may compromise the security of the cards during the shuffling process and create opportunities for tampering with the cards. Furthermore, in most of the known shuffler designs, shuffling of the playing card may be limited by the particular mechanism used in the shuffler for loading additional cards in the shuffler.

BRIEF SUMMARY

In some embodiments, the present disclosure includes a card handling system including a shuffling device comprising a first card sensing device, a shoe device comprising a second card sensing device, a card transfer system for transferring cards from the shuffling device into the shoe device, and a processor for controlling operation of the system.

In additional embodiments, the present disclosure includes a shuffling device including a card infeed area, a first card feed mechanism for transporting cards from the card infeed area to a carousel comprising a plurality of compartments, and a divider positioned proximate to the carousel and operable to contact at least one card positioned within at least one compartment of the plurality of compartments of the carousel.

In yet additional embodiments, the present disclosure includes a shoe device including a card storage area and a card loading system for loading cards into the card storage area through an opening in a base of the shoe device.

In further embodiments, the present disclosure includes a method of providing cards during casino table game play. The method includes receiving cards into a shuffling device positioned at least partially below a playing surface of a gaming table, obtaining card information including a rank and a suit of each card as the card moves through the shuffling device, transporting the card from the shuffling device to a shoe device positioned over a playing surface of a gaming table, obtaining card information including a rank and a suit of each card as the card moves through the shoe device, and supplying the card through a card output area of the shoe device.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure provided with reference to the accompanying drawings, in which:

DETAILED DESCRIPTION

The illustrations presented herein are not actual views of any particular device, system, or components thereof, but are merely idealized representations that are employed to describe embodiments of the present disclosure. Additionally, elements common between figures may retain the same numerical designation for convenience and clarity.

Figure 1:
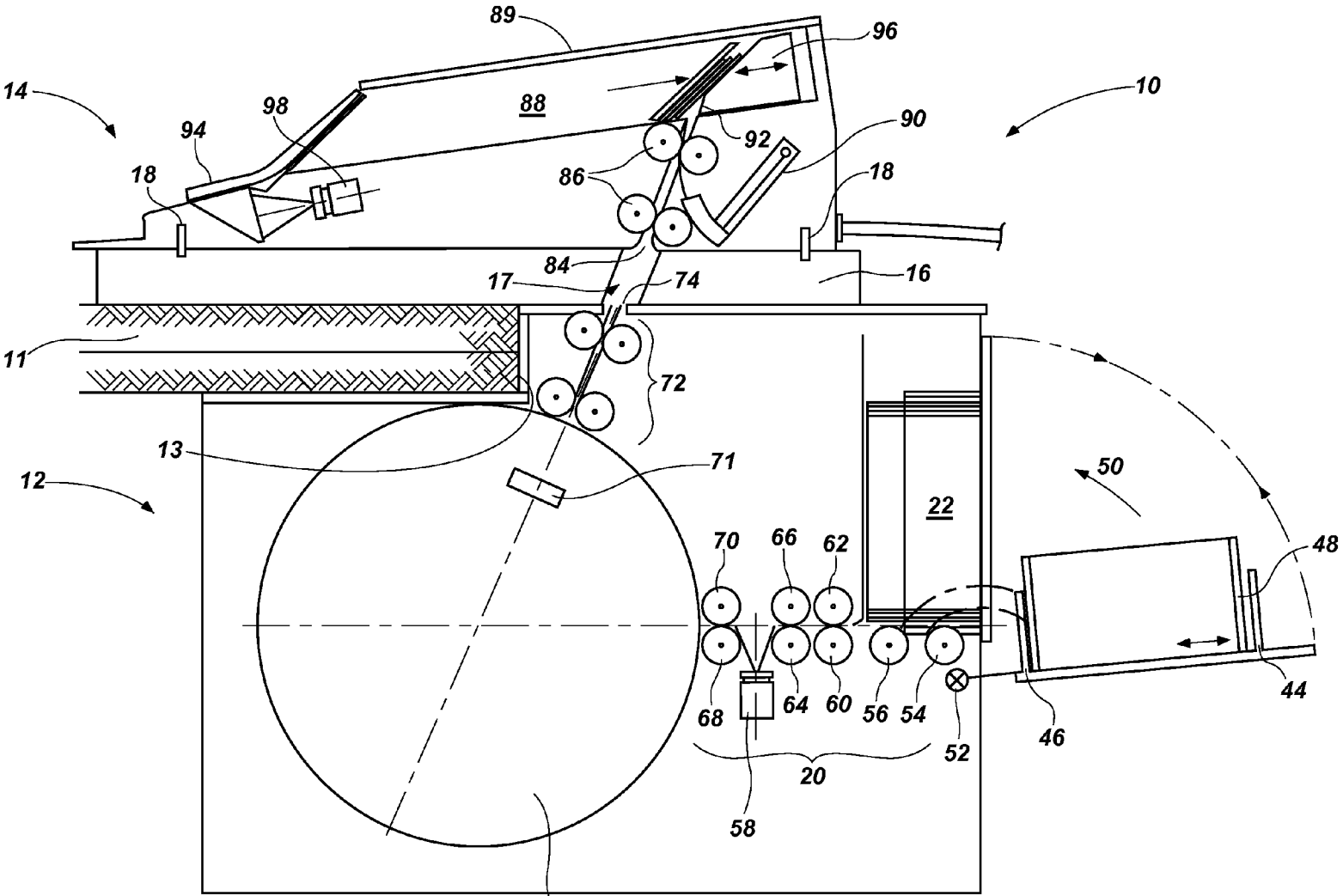
FIG. 1 is a partial cross-sectional side view of a card handling system including a shuffling device and a shoe device in accordance with an embodiment of the present disclosure.

FIG. 1 is a partial cross-sectional side view of an embodiment of a card handling system 10 including card handling devices such as, for example, a shuffling device 12 and a shoe device 14. The card handling system 10 may be implemented to provide shuffled (e.g., randomized, sorted, etc.) cards for use in, for example, a casino table game (e.g., baccarat, blackjack, CASINO WAR®, or other single- and multi-deck games). The card handling system 10 may include a playing card infeed area (e.g., a card input area 22 in the shuffling device 12) for supplying playing cards to the card handling system 10 and card output area (e.g., a discharge end 94 of the shoe device 14) for supplying playing cards for use in a game (e.g., for use by a dealer).

As shown in FIG. 1, the card handling system 10 may be positioned such that the shuffling device 12 and the shoe device 14 are mounted to a gaming table 11 in an orientation to supply playing cards from the shuffling device 12 to the shoe device 14. For example, the shoe device 14 may be mounted (e.g., removably mounted) over the gaming table 11 (e.g., over or on a playing surface of the gaming table 11) while the shuffling device 12 is mounted below (e.g., at least partially underneath, external to a playing surface, etc.) the gaming table 11 proximate to the shoe device 14. In other words, the shoe device 14 is positioned relatively more proximate to a playing surface of the gaming table 11 while the shuffling device 12 relatively more distant from (i.e., distal or external to) the playing surface of the gaming table 11 as compared to the shoe device 14. In some embodiments, the card handling system 10 may be at least partially mounted proximate a side portion 13 of the gaming table 11. For example, a portion of the card handling system 10 (e.g., the shuffling device 12) may be partially mounted below the gaming table 11 and may extend from the side portion 13 of the gaming table 11. The portion of the card handling system 10 extending from the side portion 13 of the gaming table 11 may enable the shoe device 12 to be positioned directly on a portion of the card handling system 10. A portion of a card transfer system (i.e., a card path) between the shuffling device 12 and the shoe device 14 (e.g., card output 74, card path 17, discussed below) may be positioned adjacent to (e.g., external to) the gaming table 11 and may not extend through the gaming table 11. As shown in FIG. 1, such an embodiment may eliminate the need to cut holes for a card path between the shuffling device 12 and the shoe device 14 in the gaming table 11.

In some embodiments, a docking station 16 may be mounted on the gaming table 11 between the shuffling device 12 and the shoe device 14. The docking station 16 may include a mounting device (e.g., one or more alignment pins 18) protruding therefrom to receive the shoe device 14. The alignment pins 18 may align the shoe device 14 with the docking station 16 and with the shuffling device 12 in order to align a card transfer system between the shuffling device 12 and the shoe device 12. For example, the alignment pins 18 may align a card path 17 extending through the docking station 16 with an opening (e.g., card output 74) in the shuffling device 12 and an opening (e.g., card input 84) of the shoe device 14. In other embodiments, a docking station may comprise alignment pins 18 that are mounted directly into a gaming table 11 and the shoe device 14 may be disposed directly on the gaming table 11 and attached to the alignment pins 18, thereby, eliminating the need for the docking station 16 having the card path 17 formed therethrough. The alignment pins 18 may act to align the shuffling device 12, shoe device 14, and docking station 16, if implemented, to assure that playing cards properly load from the shuffling device 12 into the shoe device 14. The alignment pins 18 may enable a plurality of shoe devices 14 to be interchangeably used with the card handling system 10 by enabling each shoe device 14 to be mounted and removed from the card handling system 10 (e.g., from use with the shuffling device 12).

In some embodiments, the card handling system 10 may include a device to indicate whether a shoe device 14 is received on the alignment pins 18 before playing cards are supplied from the shuffling device 12 to the shoe device 14. For example, the card handling system 10 may include one or more sensors 15 (FIG. 5) that send a signal indicating that the shoe device 14 is received on the alignment pins 18. If the sensor 15 does not detect the shoe device 14, the card handling system 10 may prevent playing cards from being supplied from the shuffling device 12 to the shoe device 14. In some embodiments, the card handling system 10 may act to secure the shoe device 14 such that the shoe device 14 may not be removed from the card handling system 10 when playing cards are being supplied from the shuffling device 12 to the shoe device 14. For example, the alignment pins 18 may be received within recesses formed in the shoe device 14 and a portion of one or more alignment pins 18 (e.g., a tab formed thereon) may secure the shoe device 14 to an adjacent structure (e.g., the docking station 16, the gaming table 11) during operation of the card handling system 10.

Referring still to FIG. 1, playing cards may be supplied to the card handling system 10 through a card input area 22 in the shuffling device 12. In some embodiments, the shuffling device 12 may comprise any suitable shuffling device such as, for example, those disclosed in U.S. Pat. No. 5,676,372 to Sines et al. that issued Oct. 14, 1997, U.S. Pat. No. 6,254,096 to Grauzer et al. that issued Jul. 3, 2001, U.S. Pat. No. 6,651,981 to Grauzer et al. that issued Nov. 25, 2003, and U.S. Pat. No. 6,659,460 to Blaha et al. that issued Dec. 9, 2003, the disclosures of each of which are incorporated herein in their entireties by this reference. The shuffling device 12 may have a wheel or carousel design that may be somewhat similar to the card-shuffling device disclosed in the aforementioned and incorporated by reference U.S. Pat. No. 6,659,460. For example, a card feed system 20 delivers cards from a card input area 22 to a multi-compartment carousel 24.

In some embodiments, the card input area 22 of the card handling system 10 may include a translatable magazine 44 (e.g., a rotatable magazine) that may be disposed at least partially within the card input area 22 in a closed position. As shown in FIG. 1, in the open position, the magazine 44 may be positioned to be substantially horizontal (e.g., horizontal with respect to a surface (e.g., floor) on which the card handling system 10 or gaming table 11 is placed). The magazine 44 may have a first fixed side 46 and a movable side 48 that is biased in a direction toward the fixed side to retain playing cards between the sides 46, 48 of the magazine 44. For example, the movable side 48 may be movably coupled to the magazine 44 (e.g., to a track on or in a portion of the magazine 44) and may be biased (e.g., by a spring) in a direction toward the fixed side 46 in order to clamp a horizontal stack of playing cards between the sides 46, 48 (e.g., where a face of each playing card is oriented substantially transverse to a path of the card feed system 20). In some embodiments, a removable cartridge is positioned in the magazine and locks into place in a rotatable support structure. Once the rotatable magazine 44 is loaded with playing cards, the magazine 44 may be rotated into the closed position in direction 50 about axis 52 until the stack of cards is substantially vertical (e.g., where a face of each playing card is oriented substantially parallel to the path of the card feed system 20). The magazine 44 may be locked into a vertical position before the shuffler device 12 is activated. In some embodiments, one or more sensors 47 (FIG. 5) may indicate that the magazine 44 is in a closed position before operation of the card handling system 10 (e.g., the shuffling device 12) is enabled.

In other embodiments, playing cards may be inputted directly into card input area 22 (e.g., a fixed magazine disposed in the card input area 22) or into a removable magazine that is removably coupled to the card handling system 10. For example, the magazine 44 may comprise a removable cartridge (e.g., a frame member) that holds a stack of cards (e.g., six to eight decks of playing cards in a face-to-back orientation). In such an embodiment, the cartridge may be preloaded with one or more decks of playing cards and may be disposed in (e.g., inserted into) the magazine 44. With the cartridge loaded in to the magazine 44, the magazine 44 may be inserted into the card handling system 10.

Figure 1A:
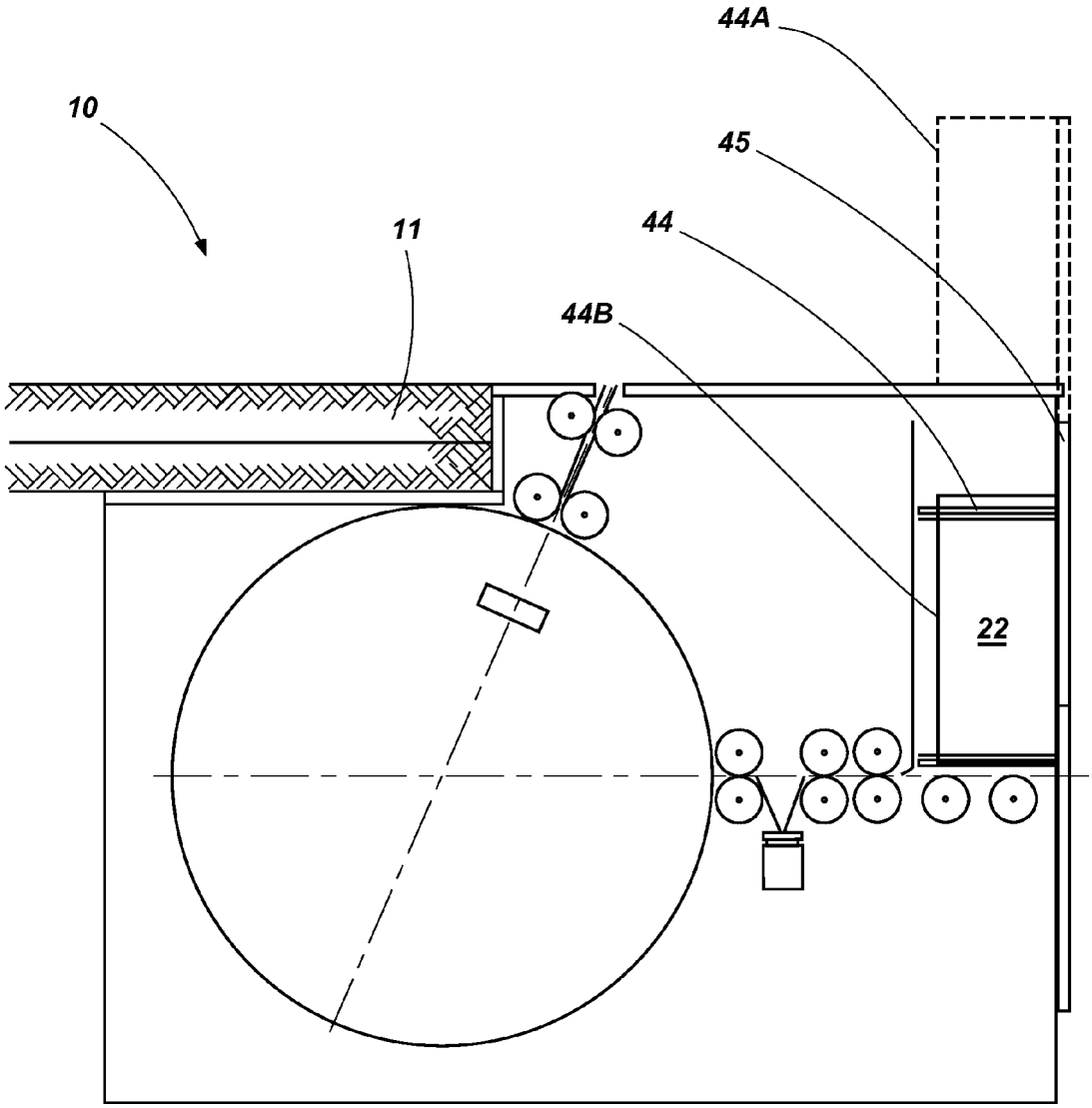
FIG. 1A is a partial cross-sectional side view of a portion of a card handling system in accordance with another embodiment of the present disclosure.

In yet other embodiments and as shown in FIG. 1A, the card input area 22 of the card handling system 10 may include a translatable magazine 44 that is movable between a raised position 44A and a lowered position 44B by an elevator system 45. The translatable magazine 44 may be substantially similar to that described above with reference to FIG. 1. As shown in FIG. 1A, in the raised position, the magazine 44 may be positioned such that at least a portion of the magazine 44 is accessible from the gaming table 11 (e.g., from the playing surface of the gaming table 11). In the raised position, playing cards to be inserted into the card handling system 10 may be loaded into the magazine 44. Once the translatable magazine 44 is loaded with playing cards, the magazine 44 may be displaced into the lowered position (i.e., into the card input area 22) by the elevator system 45 (e.g., an automatic system that is operated by the dealer, the control system 200 (FIG. 5), or combinations thereof).

Referring again to FIG. 1, playing cards inputted into the card input area 22 may be transported from the card input area 22 to the multi-compartment carousel 24 by the card feed system 20. The card feed system 20 may include a set of pick-off rollers 54, 56 that transport cards individually. Additional pairs of rollers 60, 62, 64, 66, 68, 70 may displace playing cards from the card input area 22 to the multi-compartment carousel 24. In some embodiments, one or more components of a card sensing system 58 may be placed proximate to the card input area 22 and card feed system 20 may transport cards past the card sensing system 58. For example, a component or device (e.g., a sensor) of a card sensing system 58 may be disposed along the card feed system 20 to inspect the playing cards before insertion into the multi-compartment carousel 24. The card sensing system 58 may be used to inspect the playing cards and to verify data from inspection of the playing cards against a data set contained in a memory device (e.g., a memory device of the card sensing system 58, of a control system 200 (FIG. 5), etc.) to verify the set of playing cards has not been tampered with (e.g., by verifying that the set of playing card is complete). In some embodiments, the card sensing system 58 may comprise one or more of the components disclosed in U.S. Patent Application Publication No. US 2007/0018389 A1 to Downs that published Jan. 25, 2007, now U.S. Pat. No. 7,933,448, issued Apr. 26, 2011, or in U.S. Pat. No. 7,764,836 to Downs et al., issued Jul. 27, 2010, the disclosure of each of which is incorporated herein in its entirety by this reference.

The shuffling device 12 may include a drive mechanism (e.g., a stepper motor) for rotating the multi-compartment carousel 24 in multiple directions (e.g., clockwise and counterclockwise) and may align a selected compartment 25 (FIG. 2) with the card feed system 20 in order to load one or more playing cards into the selected compartment 25 of the multi-compartment carousel 24. In some embodiments, the drive mechanism may be similar to the drive mechanisms disclosed in the aforementioned and incorporated by reference U.S. Pat. No. 6,659,460 and U.S. Pat. No. 7,766,332 to Grauzer et al. that issued Aug. 3, 2010, the disclosure of which is incorporated herein in its entirety by this reference.

Figure 2:
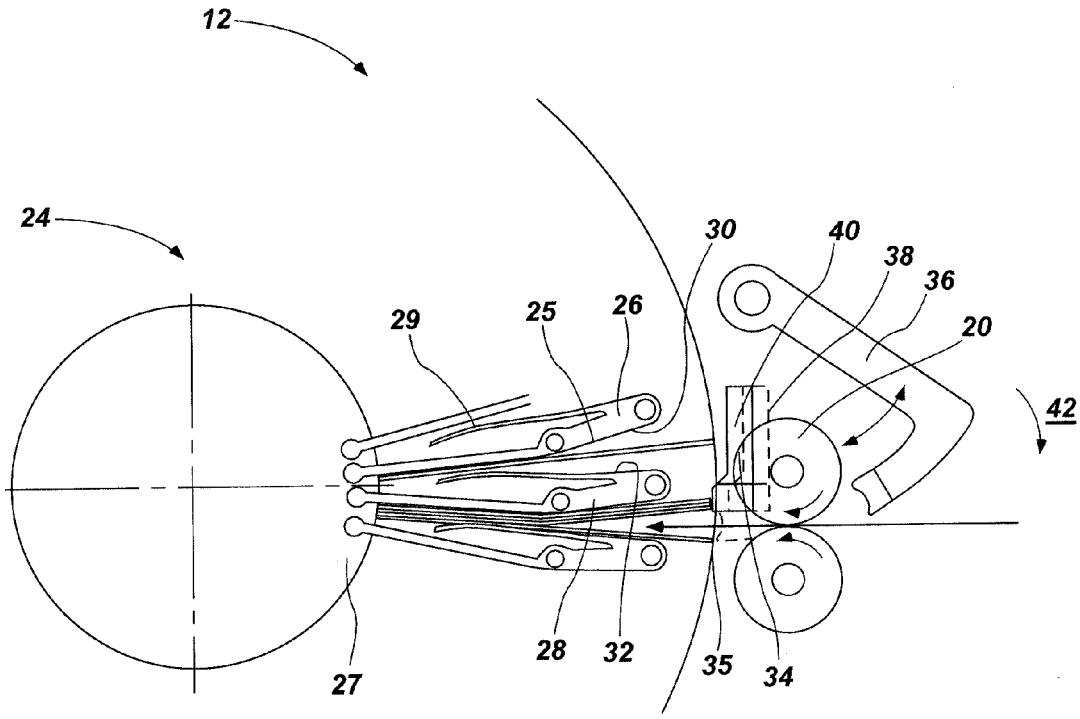
FIG. 2 is a partial cross-sectional view of a portion of a shuffling device that may be used in embodiments of card handling systems of the present disclosure, such as the card handling systems shown in FIGS. 1 and 1A.

FIG. 2 is a partial cross-sectional view of the shuffling device 12. As shown in FIG. 2, the multi-compartment carousel 24 may include a plurality of compartments 25 (e.g., forty-three (43) compartments) formed by fingers 26, 28 extending from a rotatable center member 27. Each compartment 25 may be defined by two adjacent fingers 26, 28 of the multi-compartment carousel 24. In some embodiments, the fingers 26, 28 may include a leaf spring 29 for holding playing cards securely within the compartment 25 after insertion in the multi-compartment carousel 24. It is noted that in other embodiments, the multi-compartment carousel 24 may include fewer than forty-three (43) compartments 25 or more than forty-three (43) compartments 25.

The shuffling device 12 may include a packer arm device 36 for assisting the insertion of playing cards into each compartment 25 of the multi-compartment carousel 24. The packer arm device 36 may be rotatably coupled to a portion of the card handling system 10 and may translate partially along a path of the card feed system 20 to ensure proper loading of playing cards within the multi-compartment carousel 24. In some embodiments, the packer arm device 36 may be similar to the devices disclosed in the aforementioned and incorporated by reference U.S. Pat. No. 6,659,460 and U.S. Pat. No. 7,766,332.

The shuffling device 12 may include a divider 34 that, in a retracted position 38, may avoid contact with an edge of one or more playing cards (e.g., a stack of playing cards) disposed within the compartment 25 of the multi-compartment carousel 24 that is aligned with feed rollers 20. In an engaged position 40, the divider 34 may contact playing cards and may apply a force thereto. A contact end 35 of the divider 34 may contact an edge of one or more playing cards in a compartment 25 in order to retain the edge of the one or more playing cards proximate to the contact end 35 of the divider 34. For example, the contact end 35 of the divider 34 may contact an edge of one or more playing cards to cause a frictional force therebetween. In some embodiments, the contact end 35 of the divider 34 may contact an edge of one or more playing cards and apply a force thereto in order to at least partially bend a portion of one or more of the playing cards. For example, the divider 34 may cause a slight bend in a stack of playing cards and may cause a separation between the playing cards or between a portion of one or more of the playing cards and a portion of a finger 26, 28 on which the playing cards are disposed. In some embodiments, the contact end 35 of the divider 34 may be smooth, grooved, ribbed, straight, sloped, or covered with high friction material (e.g., rubber or neoprene) in order to retain an edge of one or more of the playing cards.

Figure 3:
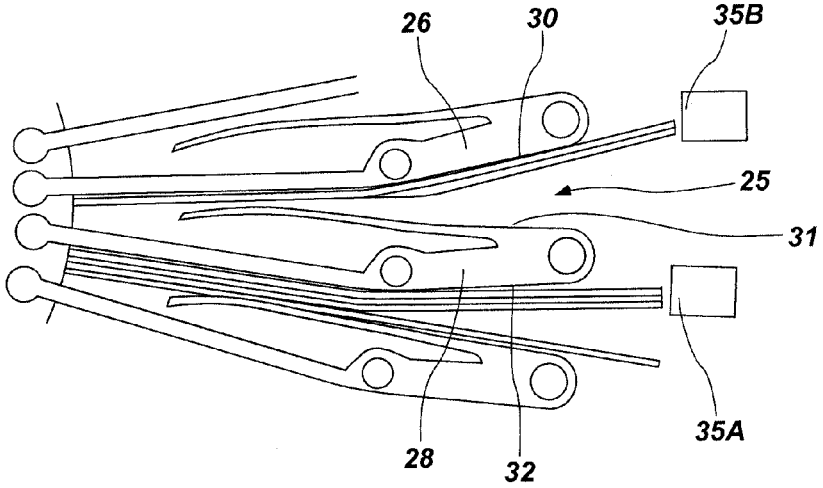
FIG. 3 is an enlarged, partial cross-sectional view of a portion of the shuffling device shown in FIG. 2.

FIG. 3 is an enlarged, partial cross-sectional view of a portion of the shuffling device 12 shown in FIG. 2. Referring to both FIGS. 2 and 3, the fingers 26, 28 may include a beveled edge 30, 32 that enables insertion of playing cards on top of or below existing cards in the compartment 25. When the divider 34 is in the engaged position 40, one or more playing cards in a compartment 25 of the multi-compartment carousel 24 may be displaced relative to the divider 34 to create an opening for insertion of one or more additional playing cards between two playing cards positioned within the same compartment 25 or between one or more playing cards and a portion of the compartment 25. For example, the multi-compartment carousel 24 may be rotated in a direction (e.g., clockwise 42). In some embodiments, the control system 200 (FIG. 5) may cause a stepper motor of the drive system to rotate the multi-compartment carousel 24 the number of steps necessary to create an opening between two selected cards. In other embodiments, once in the engaged position 40, the divider 34 may be translated to create an opening for insertion of one or more additional playing cards.

FIG. 3 further illustrates two examples of implementations of a contact end 35A, 35B of a divider 34 (FIG. 2). As shown in FIG. 3, contact end 35A creates an opening between one or more playing cards and other playing cards in the compartment 25 for insertion of one or more additional playing cards between playing cards already disposed within the compartment 25. By way of further example, contact end 35B creates an opening between one or more playing cards and a surface 31 of the finger 28 that the playing cards are disposed on for insertion of one or more additional playing cards between playing cards already disposed within the compartment 25 and a surface of the compartment on which the playing cards are disposed (e.g., a portion of finger 28 positioned beneath or below the playing cards in the compartment 25 as the playing cards are orientated during loading of the compartment 25).

Referring back to FIG. 2, as can be appreciated from the description above, the shuffling device 12 including the divider 34 may enable insertion of one or more cards into the multi-compartment carousel 24 above all cards currently in the compartment 25, below all cards currently in the compartment 25, and between selected cards already in the compartment 25. Such flexibility in the insertion of playing cards in the shuffling device may enhance the ability of the shuffling device to shuffle (e.g., randomize, sort, etc.) the playing cards that may not be possible with similar shuffling devices such as those mentioned above.

In some embodiments, the divider 34 may be implemented after several playing cards (e.g., two, three, or more playing cards) have already been delivered to one or more of the compartments 25. As the number of playing cards in the compartment 25 increases, the divider 34 increases the number of potential positions of the playing cards within the compartments 25 and may improve shuffling efficiency by enabling each compartment 25 to hold more playing cards by increasing the number of potential positions of each card within the compartments 25. In some embodiments, multiple dividers are provided, one per compartment. In other embodiments, only one divider is provided proximate the infeed rollers 20 (FIG. 2).

In some embodiments, the divider 34 may be movably coupled to a portion of the card handling system 10 (e.g., the shuffling device 12). For example, the divider 34 may be pivotally coupled to a portion of the shuffling device 12 and may rotationally translate between the retracted position 38 and the engaged position 40. In other words, the contact end 35 of the divider 34 may translate along more than one axis (e.g., along the x-axis and y-axis). In other embodiments, the divider 34 may be restrained to a single axis of movement (e.g., along the x-axis). For example, the divider 34 may be slidably coupled to a portion of the shuffling device 12 and may transition the contact end 35 of the divider 34 laterally between the retracted position 38 and the engaged position 40. In such an embodiment, the divider 34 may be moved along the x-axis to engage and disengage one or more cards in a compartment 25. When engaged with the cards, an opening may be formed in the cards in the compartment 25 by rotating the multi-compartment carousel 24 as mentioned above. In yet other embodiments, the contact end 35 of the divider 34 may move along the x-axis and y-axis to both engage and disengage one or more cards in a compartment 25 by moving along the x-axis and to form an opening in the cards in the compartment 25 by moving along the y-axis.

In some embodiments, one or more sensors and, optionally, a controller for receiving signals from the sensors and for controlling a motor 23 (FIG. 5) may also be provided in the card handling system 10. The sensors may be configured to detect a relative position of the multi-compartment carousel 24 so as to enable the control system 200 (FIG. 5) of the card handling system 10 to identify which compartment 25 is aligned to receive a card from the card feed system 20 and which compartment 25 is aligned for ejection of any cards therein by the card transfer system (e.g., a discharge feeder assembly 72 discussed below). For example, the card handling system 10 may include one magnetic sensor that is configured to detect another magnet positioned on the multi-compartment carousel 24.

Figure 3A:
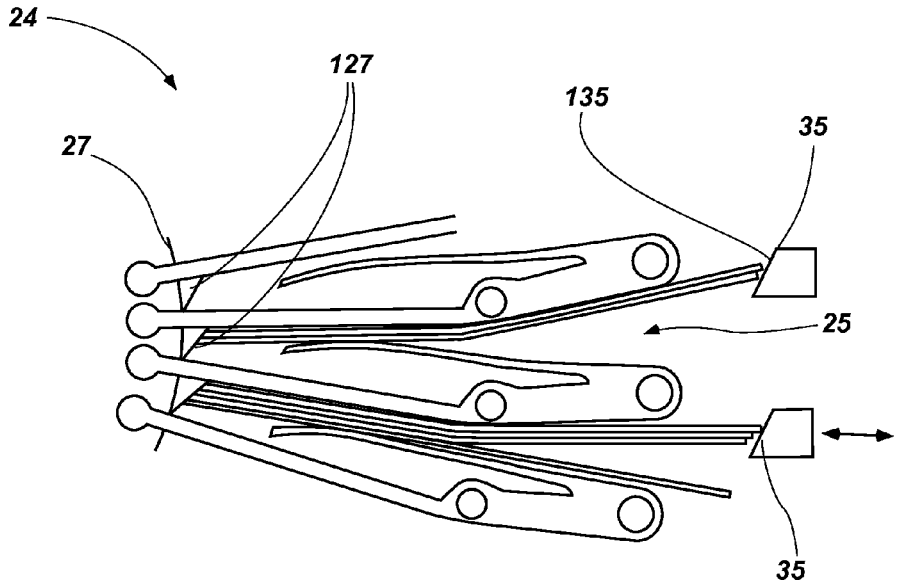
FIG. 3A is an enlarged, partial cross-sectional view of a portion of a shuffling device in accordance with another embodiment of the present disclosure.

In some embodiments and as shown in FIG. 3A, a portion of the multi-compartment carousel 24 may include a surface that provides an offset between at least some of the playing cards (e.g., a lateral offset along the faces of the playing cards) in one or more of the compartments 25 in the multi-compartment carousel 24. For example, an inner portion of the compartments 25 (e.g., a surface of the center member, a surface proximate to the center member 27, or combinations thereof) may comprise an angled surface 127. As playing cards are loaded into the compartment 25, an edge of each of the playing cards will contact a portion of the angled surface 127 providing an offset between at least some of the playing cards. In some embodiments, the angled surface 127 may be orientated such that an edge of a playing card extends from the compartment 25 a distance further than an edge of the playing card on which it is stacked. In other embodiments, a surface of the compartments 25 may be oriented to create an offset opposite to that shown in FIG. 3A or combinations thereof. Such offsets in the playing cards may enable the divider 34 to contact a selected edge of one or more playing cards in the compartments 25. As further shown in FIG. 3A, in some embodiments, the contact end 35 of the divider 34 may also include an angled surface 135 for selectively contacting an edge of one or more playing cards in the compartments 25.

Referring back to FIG. 1, a card pusher 71 may transfer playing cards (e.g., groups of randomized playing cards) from a compartment 25 of the shuffling device 12 and into a card transferring system for transferring groups of playing cards from the shuffling device 12 to the shoe device 14. If the shuffler is delivering only one card to the compartment of the shoe device 14, the card pusher 71 would push only one card. In some embodiments, the card pusher 71 may be similar to the card output devices disclosed in the aforementioned and incorporated by reference U.S. Pat. No. 6,659,460 and U.S. Pat. No. 7,766,332. The playing cards may move (e.g., under the force of a transport mechanism such as, for example, one or more rollers in a discharge feeder assembly 72) as a set (e.g., one or more playing cards) through an output opening 74 in the shuffling device 12 through the card path 17 in the docking station 16 (if implemented) and then into the shoe device 14 through an opening 84 in a lowermost portion (e.g., base) of the shoe device 14. Stated in another way, the card transferring system may, for example, include one or more mechanisms (e.g., discharge feeder assembly 72, transport mechanism 86) and associated openings in the shuffling device 12 and the shoe device 14 (e.g., openings 74, 84) in order to transfer playing cards from the shuffling device 12 to the shoe device 14 (e.g., without the need for manual intervention). In some embodiments, where the docking station 16 is implemented, the docking station 16 may include a transport mechanism such as, for example, one or more rollers mounted proximate to the card path 17 to force the playing cards along the card path 17 and into the shoe device 14.

A card loading system (e.g., transport mechanism 86 in the base of the shoe device 14) transfers the playing cards into a card storage area 88 of the shoe device 14. In some embodiments, a rotating packer arm 90 may contact a trailing end of the playing cards and force the cards through an aperture 92 in the card storage area 88. The playing cards may be positioned in the card storage area 88 of the shoe device 14 where the playing cards may be advanced to a discharge end 94 of the shoe device 14. For example, a movable card weight 96 may push the playing cards along a lower declining surface of the card storage area 88 in the shoe device 14 toward the discharge end 94 of the shoe device 14. In some embodiments, the movable card weight 96 may be moved by means of gravity or by means of a mechanical force (e.g., one or more springs, a rack and pinion mechanism, etc.).

In some embodiments, the shoe device 14 may include one or more components of a card sensing system 98 similar to the card sensing system 58 discussed above with regard to the shuffling device 12 (e.g., a component or device of a card recognition system such as, for example, a sensor). In some embodiments, card sensing systems 58, 98 may comprise components of a single card sensing system. The card sensing system 98 of the shoe device 14 may be in data communication with the card sensing system 58 of the shuffling device 12. In some embodiments, the shoe device 14 may be in communication (e.g., wirelessly or wired communication) with a control system 200 (FIG. 5) of the shuffling device 12 even when the shoe device 14 is disconnected from the shuffling device 12 (e.g., removed from the alignment pins 18 and, in some embodiments, the docking station 16).

The sensor of the card sensing system 98 in the shoe device 14 may be capable of recognizing the rank and suit of the playing cards. In some embodiments, the card sensing system 98 may (e.g., by sending information to the control system 200 (FIG. 5)) monitor the resulting hands provided by the card handling system 10 to the players. For example, the information of the resulting hands provided from the card handling system 10 may be used to secure a correct payout rate or may be displayed, tracked, or otherwise analyzed. In some embodiments, sensors to sense card location may be used to determine hand composition.

In some embodiments, the information from the sensor 98 may be sent to a portion of the control system 200 (FIG. 5) of the shuffling device 12 and a comparison is performed to confirm all cards exiting the shoe device 14 belong to the original set of playing cards supplied to shuffling device 12. For example, a set file may be generated as playing cards are fed into the shuffling device 12 and are inspected by the sensor of the card sensing system 58 in the shuffling device 12. In a similar manner, data from the card sensing system 58 of the shuffling device 12 may be used to perform a comparison (e.g., by the control system 200) to verify that the playing cards that have exited the shoe device 14 are the same cards that were inputting into the shuffling device 12. In applications that re-use cards, the shoe sensor 98 data can be used to confirm that the cards being inputted into the shuffler are the same. In some embodiments, sensors may detect special markings on the cards, such as, for example, a lot number, a casino identifier, a shoe number, a shift number, a table number, any other known type of special marking, or combinations thereof.

As above, in some embodiments, the card sensing system 98 may comprise one or more of the components disclosed in the aforementioned and incorporated by reference U.S. Patent Application Publication No. US 2007/0018389 A1. In some embodiments, the card sensing systems 58, 98 may include one or more controllers (e.g., an electronic signal processor, such as, for example, a field programmable gate array (FPGA) device) for receiving signals from the sensors (e.g., camera device or line scanning device) to determine rank and/or suit of each card being read or sensed by the card sensing systems 58, 98.

In some embodiments, the card handling system 10 may provide a cut card feature. For example, an upper portion of a shoe device 114 (e.g., a cover 89 over the card storage area 88 of the shoe device 14) may prevent the dealer or players from accessing the playing cards in the card storage area 88 (e.g., the cards may only accessible through the discharge end 94 of the shoe device 14 and may prevent the insertion of a cut card). The card handling system 10 may enable a cut card to be fed into the shoe device 14 by the shuffling device 12. For example, a cut card may be inserted into the card input area 22 and fed into the card handling system 10. In some embodiments, the card sensing system 58 may identify the cut card and place it in a predetermined location (e.g., into a selected compartment 25 of the multi-compartment carousel 24). The shuffling device 12 may load the cut card into the shoe device 12 in a predetermined position (e.g., the four hundredth card out of four hundred sixteen cards in a set of eight decks). When the cut card is removed from the shoe device 14 (e.g., by the dealer), the cut card may indicate to cease outputting cards from the supply contained the shoe device 12. In some embodiments, the cut card may be inserted by the shuffling device 12 after the shoe device 14 has been loaded. For example, the cut card may be inserted by the shuffling device 12 during unloading of the shoe device 14. By way of further example, after a predetermined number of cards have been dealt from the shoe device 14, the cut card 12 may be provided from the shuffling device 12.

Figure 4:
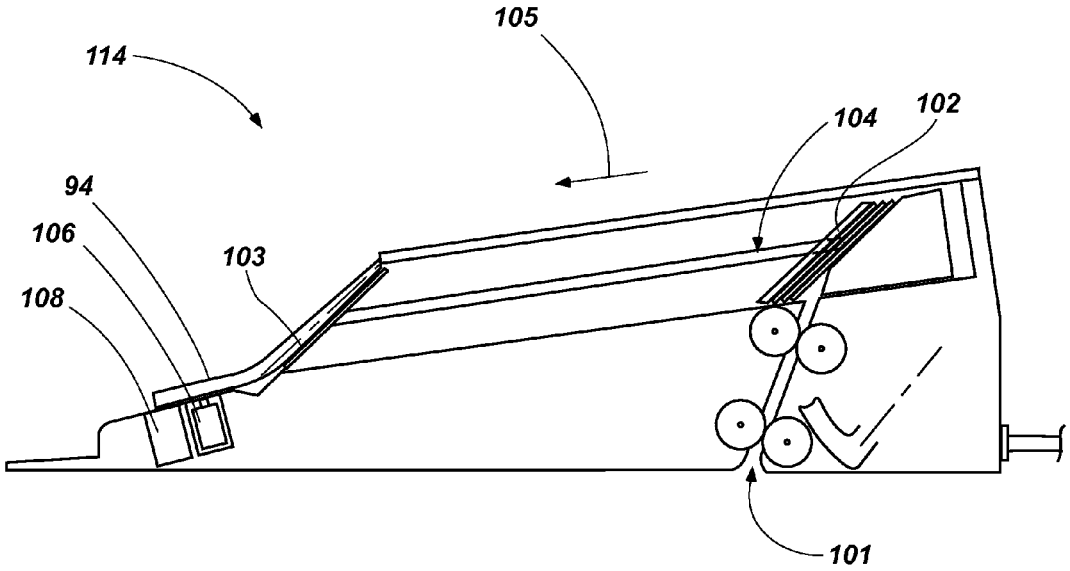
FIG. 4 is a partial cross-sectional view of a shoe device that may be used in embodiments of card handling systems of the present disclosure, such as the card handling systems shown in FIGS. 1 and 1A.

FIG. 4 is a partial cross-sectional view of another embodiment of a shoe device 114. As shown in FIG. 4, the shoe device 114 may include an opening 101 formed in a base of the shoe device 114 such as, for example, a portion of the shoe device 114 resting on an adjacent structure (e.g., the gaming table 11, the shuffling device 12, docking station 16, etc.). The opening 101 is positioned to receive playing cards from another portion of the card handling system 10 (e.g., the shuffling device 12, the docking station 16). The shoe device 114 may include a movable support plate 103 that is movable along a slot 104 in the sides of the shoe device 114. The plate 103 may be moved into a loading position 102 when the shoe is empty, and advances in a direction shown by arrows 105 toward the discharge end of the shoe device 114 along the slot 104 until reaching a final position 103 when the playing card inventory in the shoe device 114 has been exhausted. The support plate 103 aligns cards being loaded and prevents the cards from falling down and blocking the infeed aperture.

In some embodiments, the shoe device 114 may include a card blocking feature that enables the shoe device 114 (e.g., the control system 200 (FIG. 5) of the shoe device 114) to prevent cards from being removed or inserted into the shoe device 114 during selected times (e.g., as defined by the rules of game play). For example, the shoe device 114 may include a barrier feature 106 that may selectively position a barrier in the card path (e.g., at the discharge end 94 of the shoe device 114) to prevent cards from being discharged from or inadvertently reinserted into the shoe device 114. In some embodiments, the barrier feature 106 may be movable (e.g., automatically movable by the control system 200) to a blocking position where cards may not be discharged from or inserted into the exit end of the shoe device 114 and to a retracted position where cards may be discharged from the shoe device 114. For example, the barrier feature 106 may, on a command from the control system 200, move (e.g., actuate the barrier by the use of an actuator such as, for example, a solenoid) a barrier from the retracted position to the blocking position to prevent cards from being discharged from or reinserted into the shoe device 114. The barrier feature 106 may also, on a command from the control system 200, move the barrier (e.g., actuate the barrier) from the blocking position to the retracted position to enable cards to be discharged from the shoe device 114. In some embodiments, the barrier feature 106 may be moved between the retracted position and the blocking position by one or more single direction solenoids or by a duel- or multi-direction solenoid. In some embodiments, the barrier feature 106 may be biased in one position (e.g., the retracted or the blocking position). For example, the barrier feature 106 may be biased in the retracted position (e.g., by a spring, a gravitational force, etc.) and may include a solenoid to move the barrier to and hold the barrier in the blocking position. Once the force from the solenoid is released, a biasing element may return the barrier feature 106 to the retracted position.

In some embodiments, the shoe device 114 may include a masking device 108 that at least partially conceals at least one indication of the movement of the barrier feature 106 (e.g., a sound produced by the movement of a portion of the barrier feature 106) between the retracted and blocking positions. For example, the masking device 108 may disguise the movement of the barrier feature 106 by creating an output similar to that of the barrier feature 106 during movement. By way of further example, the masking device 108 may include another solenoid that moves independently of the barrier feature 106 such that external indications of movement of the barrier feature 106 and the masking device 108 are substantially indiscernible.

It is noted that the shoe devices 14, 114 of FIGS. 1 and 4 are shown as having one of the card sensing system 98 and the barrier feature 106 for the sake of clarity in the drawings. In some embodiments, the shoe devices 14, 114 may include one or both of the card sensing systems 98 and the barrier feature 106.

It is further noted that, while the two-dimensional representations of the card handling system 10 presented herein may give an impression that components of the card handling system 10 (e.g., rollers of the card feed system 20, the divider 34, the packer arm device 36, the rotating packer arm 90, etc.) are disposed in the same plane, the components of the shuffler device 12 may be offset from one another. For example, as shown in FIG. 2, the divider 34 may be laterally offset from the rollers of the card feed system 20 and the packer arm device 36 such that the divider 34 may contact the playing cards without interference from the of card feed system 20 and the packer arm device 36.

Figure 5:
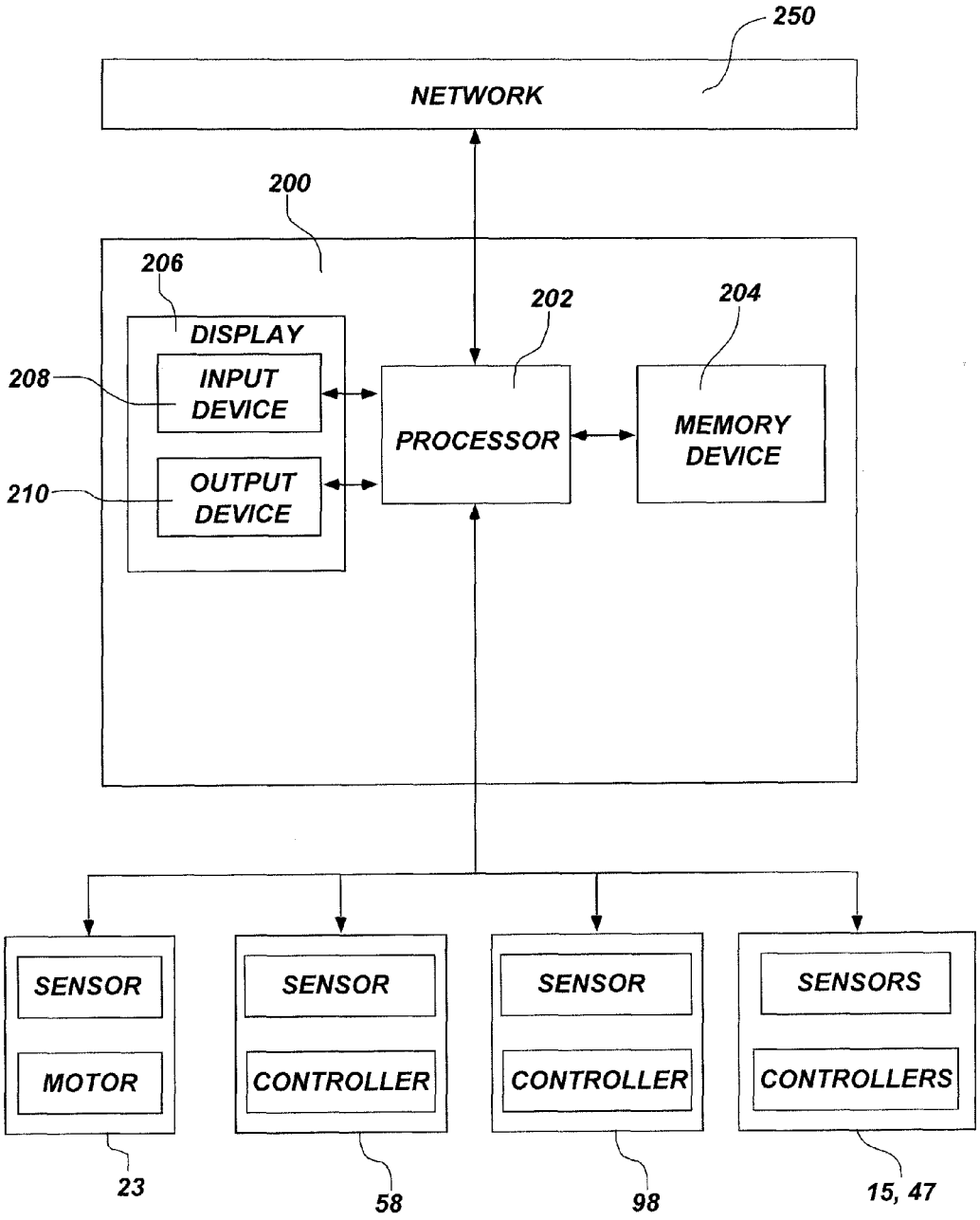
FIG. 5 is a schematic diagram of a control system that may be used in embodiments of card handling systems of the present disclosure, such as that shown in FIGS. 1 and 1A.

FIG. 5 is a schematic diagram of a control system that may be used in embodiments of card handling systems of the present disclosure, such as that shown in FIG. 1. As shown in FIG. 5, the card handling system 10 may include a control system 200 for control of the various components of the card handling system 10 such as those discussed herein. The control system 200 may be configured to receive input signals from a user (e.g., through a display 206 and input device 208), to receive input signals from one or more of the various sensors described herein, and/or for selectively controlling one or more of the various previously described active components of the card handling device 10.

In some embodiments, the entire control system 200 may be physically located within the card handling system 10. In other words, the control system 200 may be integrated into or with the components of the card handling system 10 such as, for example, the shuffling device 12 and the shoe device 14. In other embodiments, one or more components of the control system 200 may be physically located outside the card handling system 10. Such components may include, for example, a computer device (e.g., a desktop computer, a laptop computer, a handheld computer, personal data assistant (PDA), network server, etc.). Such external components may be configured to perform functions such as, for example, image processing, bonus system management, network communication and the like.

The control system 200 may include at least one electronic signal processor 202 (e.g., a microprocessor). The control system 200 also may include at least one memory device 204 for storing data to be read by the electronic signal processor 202 and/or for storing data sent to the at least one memory device 204 by the electronic signal processor 202. The control system 200 also may include one or more displays 206, one or more input devices 208, and one or more output devices 210. By way of example and not limitation, the one or more input devices 208 may include a keypad, a keyboard, a touchpad, a button, a switch, a lever, a touch screen, pressure sensitive pads, etc., and the one or more output devices 210 may include a graphical display device (e.g., a screen or monitor), a printer, one or more light emitting diodes (LEDs), a device for emitting an audible signal, etc. In some embodiments, the input device 208 and the output device 210 may be integrated into a single unitary structure (e.g., the display 206).

The control system 200 may be configured to communicate electrically with each of the previously described card sensing systems 58, 98 (e.g., sensors and controllers, if implemented, for receiving signals from the sensors of the card sensing systems 58, 98), sensors 15 for indicating attachment of the shoe device 14, 114 (FIGS. 1 and 4), sensors 47 for indicating the position of the magazine 44 (FIG. 1), and sensors 23 for controlling the motor of the multi-compartment carousel 24 (FIG. 1).

In some embodiments, the card handling system 10 may be incorporated into a table game management system by connecting or otherwise providing communication between the control system 200 of the card handling system 10 and a network 250. For example, a data port (not shown) on the card handling system 10 may be used to provide electrical communication to the network 250 through a conductive wire, cable, or wireless connection. The network 250 may communicate with the electronic signal processor 202 of the control system 200. In additional embodiments, the network 250 may communicate directly with one or more controllers of the card sensing systems 58, 98, or with both the electronic signal processor 202 of the control system 200 and the controllers of the card sensing systems 58, 98.

Embodiments of the present disclosure may also be particularly useful in providing a card handling system for a casino table game such as, for example, Baccarat, that provides a closed process between the feed or input of the unshuffled cards and the output of the cards for use in the game. As card handling systems of the present disclosure offer a system where no manual interaction is generally necessary between the input and the output of the cards, security measures generally provided with a set of playing cards may be reduced as the card handling system may verify that one or more decks of playing cards (e.g., complete and untampered decks) are provided to the input of the card handling system and, subsequently, shuffled and transferred to the shoe for output to players of the game. Such card handling systems may enable security measures for playing cards with regards to, for example, production, delivery, storage, distribution, shuffling, and the transfer from a shuffler to a shoe. Security issues created by handling cards between the shuffler and shoe can also be reduced or eliminated. Also, systems of the present disclosure prevent alteration of or tampering with the cards after shuffling and before card delivery increasing card security.

Embodiments of the present disclosure may be particularly useful in providing a card handling system that may be mounted to a gaming table or other surface such that a majority of the shuffling device of the card handling system is disposed in an area that is less obstructive to a casino game being played with cards supplied from the card handling system, such as underneath a gaming table. The card handling system may also enable attachment of portions of the card handling system to a gaming table without the need for cutting a hole in or otherwise altering the gaming table. Further, a portion of the card handling system such as the shuffling device may be interchangeably used with multiple shoe devices as one or more shoes may be connected to and subsequently removed from the card handling system. In one embodiment, the shoe may be removed from the docking station or otherwise disconnected from the shuffler to enable the dealer to move the shoe during use on the table. Finally, the card handling system may enable enhanced shuffling ability of the card handling system through components such as the divider of the shuffling device that enable insertion of playing cards into the shuffling device that may not be possible with similar shuffling devices.

Additional non-limiting example Embodiments are described below.

Embodiment 1: A card handling system, comprising: a shuffling device comprising a first card sensing device; a shoe device comprising a second card sensing device; a card transfer system for transferring cards directly from the shuffling device into the shoe device; and a processor for controlling operation of the system.

Embodiment 2: The system of Embodiment 1, wherein the card transfer system is configured to automatically transfer cards from the shuffling device into a card storage area of the shoe device.

Embodiment 3: The system of Embodiment 2, further comprising a card infeed area in the shuffling device, the card infeed area configured to supply cards into the shuffling device through a card feed system including the second card sensing device.

Embodiment 4: The system of Embodiment 3, wherein the card infeed area comprises a rotatable magazine.

Embodiment 5: The system of any one of Embodiments 1 through 4, wherein the shoe device is separable from the shuffling device.

Embodiment 6: The system of Embodiment 5, wherein the shuffling device is configured to be interchangeably used with a plurality of shoe devices.

Embodiment 7: The system of any one of Embodiments 1 through 6, wherein the card transfer system is positioned adjacent to a side portion of a gaming table.

Embodiment 8: The system of Embodiment 7, wherein the shoe device is configured to be disposed on a playing surface of a gaming table and wherein the shuffling device is configured to be disposed external to a playing surface of a gaming table.

Embodiment 9: The system of Embodiment 8, further comprising a docking station comprising at least one mounting device configured to receive the shoe device thereon.

Embodiment 10: The system of Embodiment 9, wherein the shoe device is removably mounted to the docking station.

Embodiment 11: A shuffling device, comprising: a card infeed area; a first card feed mechanism for transporting cards from the card infeed area to a carousel comprising a plurality of compartments; and a divider positioned proximate to the carousel and operable to contact at least one card positioned within at least one compartment of the plurality of compartments of the carousel.

Embodiment 12: The shuffling device of Embodiment 11, further comprising a processor for controlling the operation of the shuffling device, including translation of the divider relative to the carousel after the divider contacts the at least one card to create an opening between at least one of the at least one card and at least another card within the at least one compartment of the plurality of compartments and the at least one card and a surface of the carousel forming a portion of the at least one compartment of the plurality of compartments.

Embodiment 13: The shuffling device of Embodiment 12, wherein the processor initiates a rotation of the carousel to create the opening.

Embodiment 14: The shuffling device of Embodiments 12 or 13, wherein the divider is movable between a retracted position and an engaged position, the divider being separated from the at least one card in the retracted position and in contact with the at least one card in the engaged position.

Embodiment 15: A shoe device, comprising: a card storage area; and a card loading system for loading cards into the card storage area through an opening in a base of the shoe device, the card loading system comprising at least one set of transport rollers.

Embodiment 16: The shoe device of Embodiment 15, wherein the card loading system is positioned to receive cards through the base of the shoe device from a shuffling device.

Embodiment 17: A method of providing cards during a casino table game play, the method comprising: loading cards into a shuffling device positioned at least partially below a playing surface of a gaming table; obtaining card information including a rank and a suit of each card as the card moves through the shuffling device; shuffling the loaded cards; transporting the card from the shuffling device to a removable shoe device positioned over a playing surface of a gaming table; obtaining card information including a rank and a suit of each card as the card moves through the shoe device; and supplying the card through a card output area of the shoe device.

Embodiment 18: The method of Embodiment 17, further comprising comparing the card information obtained in the shoe device with the card information obtained in the shuffling device.

Embodiment 19: The method of Embodiments 17 or 18, wherein shuffling the loaded cards comprises: loading at least one card into at least one compartment of a carousel comprising a plurality of compartments; creating an opening with a divider between at least one of the at least one card and at least another card within the at least one compartment and the at least one card and a surface of the carousel forming a portion of the at least one compartment; and loading at least another card into the opening.

Embodiment 20: The method of any one of Embodiments 17 through 19, further comprising removably positioning the shoe device over a portion of the shuffling device.

Embodiment 21: The method of Embodiment 20, further comprising aligning the shoe device with at least one mounting device provided over the shuffling device.

Although the foregoing description contains many specifics, these are not to be construed as limiting the scope of the present disclosure, but merely as providing certain exemplary embodiments. Similarly, other embodiments of the disclosure may be devised that do not depart from the scope of the present disclosure. For example, features described herein with reference to one embodiment also may be provided in others of the embodiments described herein. The scope of the disclosure is, therefore, indicated and limited only by the appended claims and their legal equivalents, rather than by the foregoing description. All additions, deletions, and modifications to the disclosure, as disclosed herein, which fall within the meaning and scope of the claims, are encompassed by the present disclosure.

What is claimed is:

1. A card handling system, comprising:

a shuffling device comprising a first card sensing device configured to obtain card information including at least a rank of at least one card;

a shoe device comprising a second card sensing device configured to obtain card information including a rank and a suit of at least one card, wherein the shoe device is separable from the shuffling device;

a card transfer system for transferring cards directly from the shuffling device into the shoe device, wherein the shoe device is configured to be aligned with the shuffling device to load cards into a card storage area of the shoe device through the card transfer system, and wherein the shoe device is configured to be separable from the shuffling device with the cards disposed in the card storage area after the card storage area has been loaded; and a processor for controlling operation of the system.

2. The system of claim 1, wherein the card transfer system is configured to automatically transfer cards from the shuffling device into the card storage area of the shoe device.

3. The system of claim 2, further comprising a card infeed area in the shuffling device, the card infeed area configured to supply cards into the shuffling device through a card feed system including the first card sensing device.

4. The system of claim 1, wherein the shuffling device is configured to be interchangeably used with a plurality of shoe devices.

5. The system of claim 1, wherein the card transfer system is positioned adjacent to a side portion of a gaming table.

6. The system of claim 1, wherein the shoe device is configured to be disposed on a playing surface of a gaming table and wherein the shuffling device is configured to be disposed external to a playing surface of a gaming table.

7. The system of claim 6, further comprising a docking station forming at least a portion of the card transfer system and comprising at least one mounting device configured to receive the shoe device thereon.

8. A card handling system, comprising:

a shuffling device comprising:

a first card sensing device; and the shuffling device configured to supply cards into the shuffling device through a card feed system including the first card sensing device;

a shoe device comprising a second card sensing device;

a card transfer system for transferring cards directly from the shuffling device into the shoe device; and a processor for controlling operation of the system, wherein the card transfer system is configured to automatically transfer cards from the shuffling device into a card storage area of the shoe device, and wherein the card infeed area comprises at least one of a rotatable magazine and a magazine movable by an elevator system.

9. A card handling system, comprising:

a shuffling device comprising a first card sensing device;

a shoe device comprising a second card sensing device;

a card transfer system for transferring cards directly from the shuffling device into the shoe device; and a processor for controlling operation of the system, wherein the shoe device further comprises a card blocking element for selectively blocking a card path at a discharge end of the shoe device.

10. A card handling system, comprising:

a shuffling device comprising:

a first card sensing device;

a card infeed area;

a first card feed mechanism for transporting a plurality of cards from the card infeed area to a carousel comprising a plurality of compartments; and a divider positioned proximate to the carousel and operable to contact at least one card of the plurality of cards positioned within at least one compartment of the plurality of compartments of the carousel, the divider configured to contact the at least one card to create an opening between the at least one card and another card of the plurality of cards within the at least one compartment of the plurality of compartments;

a shoe device comprising a second card sensing device;

a card transfer system for transferring cards directly from the shuffling device into the shoe device; and a processor for controlling operation of the system.

11. The system of claim 10, wherein the divider is configured to translate relative to the carousel after the divider contacts the at least one card to create the opening.

12. The system of claim 11, wherein the processor is operable to initiate a rotation of the carousel to create the opening.

13. A card handling system, comprising:

a shuffling device comprising:

a first card sensing device;

a card infeed area;

a first card feed mechanism for transporting a plurality of cards from the card infeed area to a carousel comprising a plurality of compartments;

a divider positioned proximate to the carousel and operable to contact at least one card of the plurality of cards positioned within at least one compartment of the plurality of compartments of the carousel; and a processor for controlling operation of the shuffling device, including translation of the divider relative to the carousel after the divider contacts the at least one card to create an opening between the at least one contacted card and another card of the plurality of cards within the at least one compartment of the plurality of compartments, wherein the processor is operable to initiate a rotation of the carousel to create the opening, and wherein the divider is movable between a retracted position and an engaged position, the divider being separated from the at least one card in the retracted position and in contact with the at least one card in the engaged position;

a shoe device comprising a second card sensing device;

a card transfer system for transferring cards directly from the shuffling device into the shoe device; and a processor for controlling operation of the system.

14. A card handling system, comprising:

a shuffling device comprising:

a first card sensing device;

a card infeed area;

a first card feed mechanism for transporting a plurality of cards from the card infeed area to a carousel comprising a plurality of compartments; and a divider positioned proximate to the carousel and operable to contact at least one card of the plurality of cards positioned within at least one compartment of the plurality of compartments of the carousel, wherein at least one compartment of the plurality of compartments comprises a surface oriented to create a lateral offset between at least two cards of the plurality of cards positioned within the at least one compartment;

a shoe device comprising a second card sensing device;

a card transfer system for transferring cards directly from the shuffling device into the shoe device; and a processor for controlling operation of the system.

15. A card handling system, comprising:

a shuffling device;

a shoe device separable from the shuffling device, the shoe device comprising:

an enclosed card storage area, the shoe device having an opening at a discharge end of the shoe device configured to enable removal of cards from the enclosed card storage area while retaining a remainder of the cards in the enclosed card storage area; and a card loading system for loading cards into the enclosed card storage area through an opening in a base of the shoe device; and a card transfer system for transferring cards from the shuffling device into the shoe device through the opening in a base of the shoe device, wherein the shoe device is configured to be aligned with the shuffling device to load cards into the enclosed card storage area of the shoe device through the card transfer system, and wherein the shoe device is configured to be separable from the shuffling device with the cards disposed in the card storage area after the enclosed card storage area has been loaded.

16. The system of claim 15, wherein the card loading system comprises at least one set of transport rollers.

17. The system of claim 15, wherein the base of the shoe device is separable from the shuffling device and the card transfer system after the cards are loaded.

18. A card handling system, comprising:

a shuffling device;

a shoe device comprising:

a card storage area; and a card loading system for loading cards into the card storage area through an opening in a base of the shoe device; and a card transfer system for transferring cards from the shuffling device into the shoe device through the opening in a base of the shoe device, wherein the card loading system is positioned to receive cards through the base of the shoe device from the shuffling device, and wherein the shoe device further comprises a card blocking element for selectively blocking a card path at a discharge end of the shoe device, the card blocking element comprising a barrier that is movable into a blocking position responsive to a processor and movable into a retracted position responsive to the processor.

19. The system of claim 18, wherein the card blocking element is movable into a blocking position by actuation of a solenoid and movable into a retracted position by at least one of actuation of a solenoid and a biasing element.

20. The system of claim 18, wherein the shoe device further comprises a masking device for at least partially concealing an indication of movement of the card blocking element between the blocking position and the retracted position.

21. A method of providing cards during casino table game play, the method comprising:

receiving cards into the card handing system of claim 1 positioned at least partially below a playing surface of a gaming table;

obtaining card information including a rank and a suit of each card as the card moves through the shuffling device with the first card sensing device;

shuffling the loaded cards with the shuffling device;

transporting the card from the shuffling device to the shoe device positioned over the playing surface of the gaming table;

obtaining card information including a rank and a suit of each card as the card moves through the shoe device with the second card sensing device; and supplying the card through a card output area of the shoe device.

22. The method of claim 21, further comprising comparing the card information obtained in the shoe device with the card information obtained in the shuffling device.

23. The method of claim 21, wherein shuffling the loaded cards comprises:

loading at least one card into at least one compartment of a carousel comprising a plurality of compartments;

creating an opening with a divider between at least one of the at least one card and at least another card within the at least one compartment and the at least one card and a surface of the carousel forming a portion of the at least one compartment; and loading at least another card into the opening.

24. The method of claim 21, further comprising removably positioning the shoe device over a portion of the shuffling device.

25. The method of claim 24, further comprising aligning the shoe device with at least one mounting device provided over the shuffling device.

* * * * *

UNITED STATES PATENT AND TRADEMARK OFFICE

CERTIFICATE OF CORRECTION

PATENT NO. : 8,800,993 B2
APPLICATION NO. : 13/270109
DATED : August 12, 2014
INVENTOR(S) : Ernst Blaha, Peter Krenn and Todd M. Haushalter It is certified that error appears in the above-identified patent and that said Letters Patent is hereby corrected as shown below:

On the title page:

In ITEM (75) Inventors: Please delete the third named inventor "Attila Grauzer, Las Vegas, NV (US);"

The revised Item (75) Inventors, will now appear as follows:

--Inventors: Ernst Blaha, Tullnerbach (AT); Peter Krenn, Neufeld (AT); Todd M. Haushalter, Las Vegas, NV (US)--

Signed and Sealed this
Tenth Day of November, 2015

Michelle K. Lee

Michelle K. Lee
*Director of the United States Patent and Trademark Office*